US011692503B2

(12) United States Patent
Fluharty et al.

(10) Patent No.: US 11,692,503 B2
(45) Date of Patent: Jul. 4, 2023

(54) METHODS AND SYSTEMS FOR AN ENGINE WITH REMOVABLE CAMSHAFT CARRIER

(71) Applicant: Ford Global Technologies, LLC, Dearborn, MI (US)

(72) Inventors: Jeff Fluharty, Woodhaven, MI (US); Forest Heggie, LaSalle (CA); Chad Ramsby, Dearborn, MI (US); Robert Stephen Furby, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 234 days.

(21) Appl. No.: 17/114,209

(22) Filed: Dec. 7, 2020

(65) Prior Publication Data

US 2022/0178327 A1 Jun. 9, 2022

(51) Int. Cl.

| | |
|---|---|
| ***F02F 1/42*** | (2006.01) |
| ***F02F 1/24*** | (2006.01) |
| ***F01L 1/053*** | (2006.01) |
| *F01L 1/047* | (2006.01) |

(52) U.S. Cl.

CPC ..... *F02F 1/24* (2013.01); *F01L 1/053* (2013.01); *F01L 2001/0476* (2013.01)

(58) Field of Classification Search

CPC ... F01L 1/053; F01L 2001/0476; F02F 7/006; F02B 2275/02

USPC ..... 123/193.5

See application file for complete search history.

(56) References Cited

U.S. PATENT DOCUMENTS

| | | | | |
|---|---|---|---|---|
| 5,123,385 | A | 6/1992 | Sado et al. | |
| 5,220,853 | A | 6/1993 | Sado et al. | |
| 5,564,374 | A | 10/1996 | Hoffman et al. | |
| 5,645,020 | A | 7/1997 | Yamada | |
| 6,470,840 | B2 | 10/2002 | Ebesu et al. | |
| 7,107,950 | B2 * | 9/2006 | Arinaga | F01M 9/10 464/17 |
| 8,534,251 | B2 * | 9/2013 | Baker | F01L 1/053 123/90.6 |
| 10,273,901 | B2 * | 4/2019 | Fluharty | F02F 1/24 |
| 2016/0108765 | A1 * | 4/2016 | Yoon | F01M 9/102 123/294 |
| 2016/0177868 | A1 * | 6/2016 | Wicks | F02F 7/006 123/90.6 |
| 2017/0254230 | A1 * | 9/2017 | Madin | F01L 1/047 |

(Continued)

FOREIGN PATENT DOCUMENTS

| | | | |
|---|---|---|---|
| CN | 1103852 | C | 3/2003 |
| CN | 101371011 | A | 2/2009 |

(Continued)

*Primary Examiner* — Long T Tran
*Assistant Examiner* — James J Kim
(74) *Attorney, Agent, or Firm* — Vincent Mastrogiacomo; McCoy Russell LLP

(57) ABSTRACT

Methods and systems are provided for a cylinder head with an exterior wall including a removable camshaft carrier. In one example, a cylinder head includes a camshaft carrier removably couplable to a mount surface of the cylinder head and adapted to form a portion of an exterior wall of the cylinder head while coupled to the mount surface. The camshaft carrier may include a first section removably couplable to the cylinder head and a second section removably couplable to the first section, with the first section and the second section together shaped to receive a camshaft journal.

20 Claims, 9 Drawing Sheets

(56) References Cited

U.S. PATENT DOCUMENTS

| | | | | |
|---|---|---|---|---|
| 2018/0231101 | A1 | 8/2018 | Demeulenaere et al. | |
| 2020/0158047 | A1* | 5/2020 | Smith | F02F 7/006 |

FOREIGN PATENT DOCUMENTS

| | | | |
|---|---|---|---|
| EP | 1895111 | A1 | 3/2008 |
| EP | 2093391 | B1 | 9/2010 |
| EP | 1728976 | B1 | 9/2013 |
| JP | 3415180 | B2 | 6/2003 |
| JP | 2004124773 | A | 4/2004 |
| JP | 2007192101 | A | 8/2007 |
| JP | 2007192102 | A | 8/2007 |
| JP | 4036402 | B2 | 1/2008 |
| JP | 4697271 | B2 | 6/2011 |
| JP | 2011149316 | A | 8/2011 |
| JP | 2015094238 | A | 5/2015 |
| JP | 6186290 | B2 | 8/2017 |

* cited by examiner

METHODS AND SYSTEMS FOR AN ENGINE WITH REMOVABLE CAMSHAFT CARRIER

FIELD

The present description relates generally to methods and systems for a camshaft carrier mountable to a cylinder head of an engine.

BACKGROUND/SUMMARY

A cylinder head may be configured with cam bearing towers to support various engine components such as cam shafts, a fuel pump pedestal and a variable displacement engine mechanism. The cam bearing towers may connect to side walls of the cylinder head to form a rigid support structure having bearing portions that support the cam shaft and fuel pump pedestal. Further, a variable cam timing mechanism may be supported by the cam bearing towers. Alternatively, a camshaft carrier may be mounted to the cylinder head to support cam shafts and other engine components such as a camshaft bearing journal. The camshaft carrier may be directly mounted to the cylinder head via a plurality of fasteners to minimize movement and vibration of the assembly.

An example system comprising a plurality of camshaft carriers mountable to a cylinder head of an engine is shown by Okamoto in EP 1,895,111. Therein, the plurality of camshaft carriers are mountable to the cylinder head via a plurality of fasteners, each camshaft carrier having bearing portions to support portions of two cam shafts in each journal section. The cam shafts are mounted to the camshaft carriers and secured in place using cam caps and fasteners extended through each cap and the cylinder head.

However, the inventors herein have recognized potential issues with such systems. As one example, the plurality of camshaft carriers are positioned at predetermined positions relative to each journal section and the cylinder head and may result in an increased length of the engine, which may increase a cost of the engine and/or a complexity of packaging of components of the engine.

In one example, the issues described above may be addressed by a system for an engine comprising a cylinder head and a camshaft carrier removably couplable to a mount surface of the cylinder head, the camshaft carrier adapted to form a portion of an exterior wall of the cylinder head while coupled to the mount surface. In this way, a length of the cylinder head may be reduced, which may reduce an overall size and/or cost of the engine and provide additional space for other engine components such as valve train assemblies, a variable control timing (VCT) mechanism, an exhaust gas recirculation (EGR) system, etc.

As one example, the cylinder head may include a mount surface arranged within a recess formed by the exterior wall. The camshaft carrier may be shaped to seat within the recess and couple to the mount surface, with the camshaft carrier closing at least a portion of the exterior wall and separating an interior of the cylinder head from an exterior of the cylinder head. The camshaft carrier may be configured to support one or more camshaft journals, and by configuring the camshaft carrier to seat against the mount surface formed by the exterior wall, a length of the cylinder head may be reduced relative to examples in which the camshaft carrier is offset in an axial direction of the camshaft journal from the exterior wall. Further, by configuring the camshaft carrier to removably couple to the cylinder head at the exterior wall, an ease of access to head bolts configured to couple the cylinder head to an engine block may be increased, which may increase a speed and/or efficiency of assembly of the engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-8 are shown approximately to scale, although other relative dimensions may be used, if desired.

DETAILED DESCRIPTION

Figure 2:
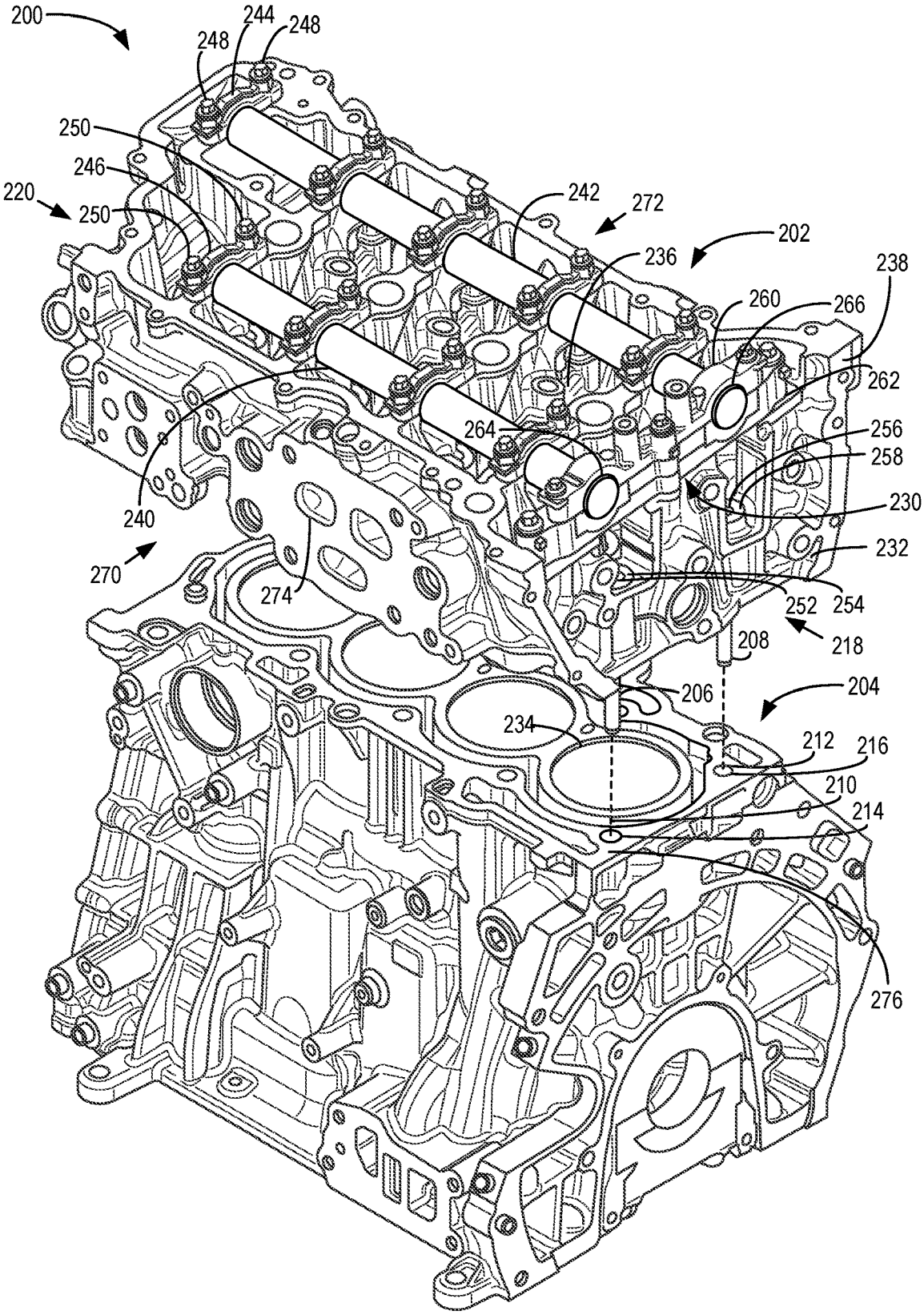
FIG. 2 shows a perspective of a cylinder head separated from an engine block, with a removable camshaft carrier coupled to an exterior wall of the cylinder head.
Figure 3:
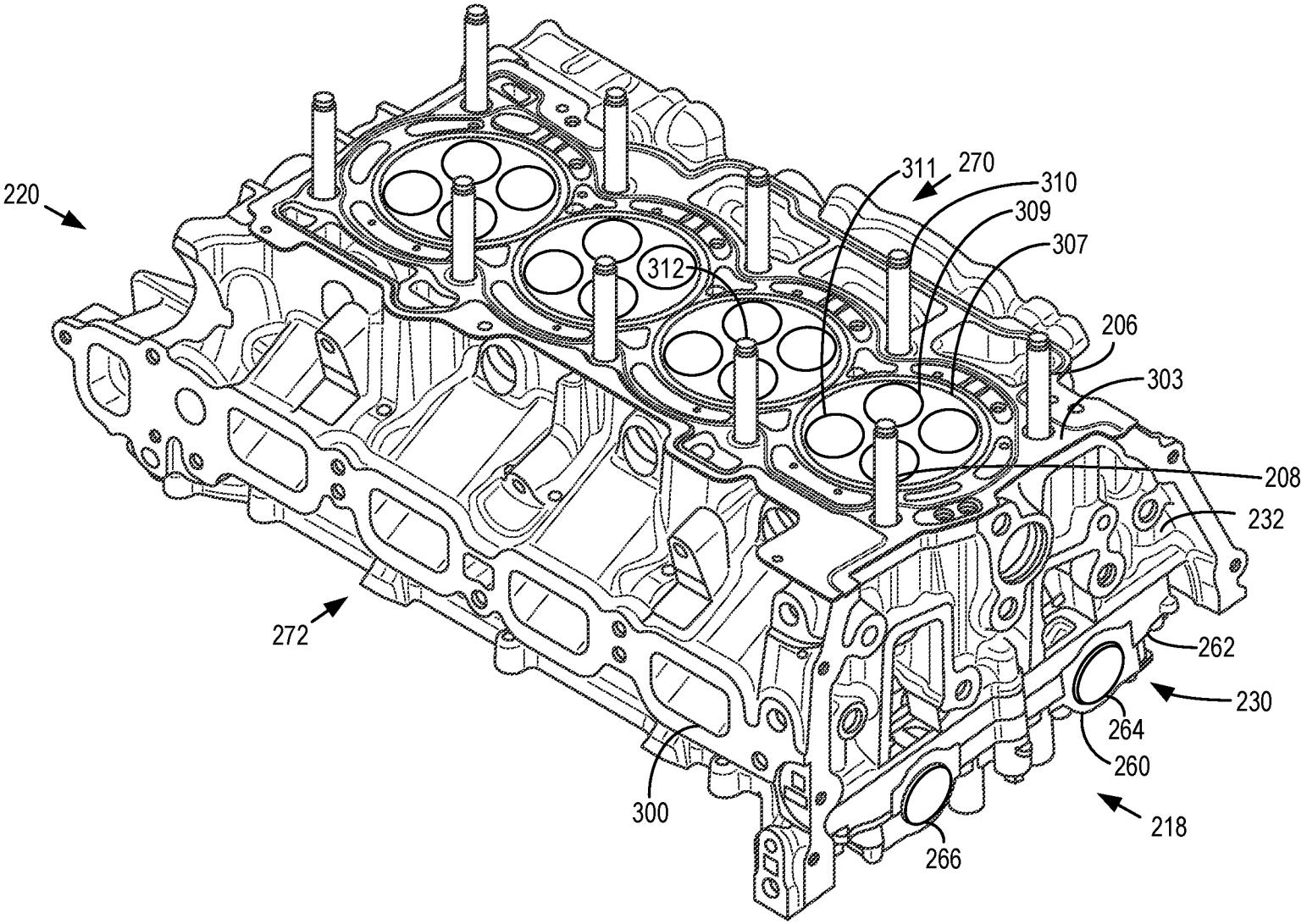
FIG. 3 shows a bottom perspective view of the cylinder head of FIG. 2.

The following description relates to systems for a camshaft carrier removably couplable to a cylinder head of an engine. The camshaft carrier may be mounted to the cylinder head to provide bearing support for a variable displacement engine (VDE) mechanism, such as used by the engine system described in FIG. 1. The camshaft carrier may directly support a camshaft coupled to a variable control timing (VCT) mechanism. As shown in FIGS. 2 and 3, the engine includes the cylinder head, which may be coupled to an engine block via a plurality of head bolts. The removable camshaft carrier is configured to mount to an exterior wall of cylinder head, with the camshaft carrier additionally configured to support at least one camshaft journal. The camshaft journals may be driven by the engine to actuate deactivatable intake or exhaust valves of one or more cylinders of the engine. The camshaft carrier may support an end portion of each camshaft journal. The camshaft carrier may be mounted within a recessed portion of the exterior wall and is configured to align with at least one head bolt coupling the cylinder head to the engine block, as shown by FIGS. 4-8. By aligning the camshaft carrier with the at least one head bolt, the camshaft journals supported by the camshaft carrier may be arranged to reduce an amount of each camshaft journal extending beyond the exterior wall.

Additionally, a length between the exterior wall of the cylinder head and the head bolts in the direction parallel with the camshaft journals may be reduced, which may increase an ease of maintenance and/or assembly of the engine. Further, the VCT mechanism may be arranged inward toward a first cylinder adjacent to the exterior wall, which may reduce the overall engine length. By reducing the overall length of the engine, manufacturing costs of the engine and/or engine weight may be decreased, where the reduced engine weight may increase engine performance. Further, an amount of space provided for mounting additional engine components may be increased.

Figure 1:
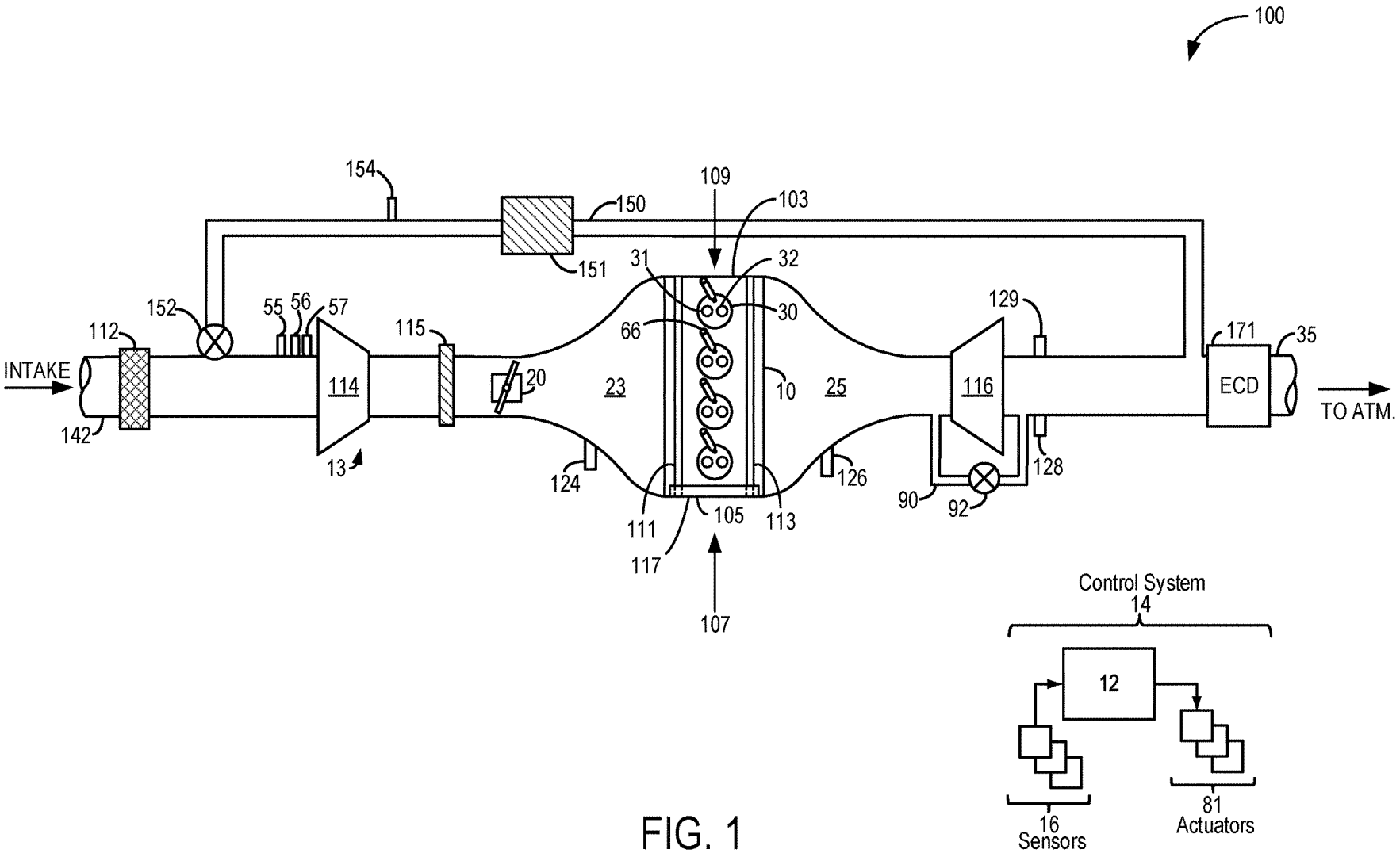
FIG. 1 schematically shows an engine system including a camshaft carrier removably couplable to an exterior wall of a cylinder head.

Referring to FIG. 1, an example engine system 100 is schematically shown. In the depicted embodiment, engine 10 is a boosted engine coupled to a turbocharger 13 including a compressor 114 driven by a turbine 116. Specifically, fresh air is introduced along intake passage 142 into engine 10 via air cleaner 112 and flows to compressor 114. In some examples, compressor 114 may be an electrically-actuated intake-air compressor. In some examples, compressor 114 may be a turbocharger compressor mechanically coupled to turbine 116 via a shaft (not shown), with the turbine 116 configured to be driven by expanding engine exhaust gas. In one embodiment, the compressor and turbine may be coupled within a twin scroll turbocharger. In another embodiment, the turbocharger may be a variable geometry turbocharger (VGT), where turbine geometry is actively varied as a function of engine speed.

Compressor 114 is fluidly coupled to throttle valve 20. Throttle valve 20 is fluidly coupled to engine intake manifold 23 (e.g., throttle valve 20 is configured to flow fluid, such as intake air, to the engine intake manifold 23). The pressure of the air charge within the intake manifold may be sensed by manifold air pressure (MAP) sensor 124. From the compressor, the compressed air charge flows through charge-air cooler (CAC) 115 and the throttle valve 20 to the intake manifold 23. Since compression of intake air by compressor 114 may result in an increased temperature of the compressed air relative to air that has not been compressed by compressor 114, CAC 115 is provided downstream of compressor 114 so that boosted intake aircharge can be cooled prior to delivery to the engine intake manifold 23. The CAC 114 may be an air-to-water heat exchanger, in some examples.

One or more sensors may be coupled to an inlet of compressor 114. For example, a temperature sensor 55 may be coupled to the inlet for measuring a temperature of the inlet of compressor 114, and a pressure sensor 56 may be coupled to the inlet for measuring a gas pressure at the inlet of compressor 114. As another example, a humidity sensor 57 may be coupled to the inlet for estimating a humidity of aircharge entering the compressor 114. Still other sensors may include, for example, air-fuel ratio sensors, etc. In other examples, one or more of the compressor inlet conditions (such as humidity, temperature, pressure, etc.) may be inferred (e.g., estimated) based on engine operating conditions. In addition, when EGR is enabled, the sensors may estimate a temperature, pressure, humidity, and air-fuel ratio of the aircharge mixture including fresh air, recirculated compressed air, and exhaust residuals received at the compressor inlet.

Intake manifold 23 is coupled to a series of combustion chambers 30 of engine 10 through a series of intake valves, such as intake valve 31. The combustion chambers are further coupled to exhaust manifold 25 via a series of exhaust valves, such as exhaust valve 32. In the depicted embodiment, a single exhaust manifold 25 is shown. However, in other embodiments, the exhaust manifold may include a plurality of exhaust manifold sections. Configurations having a plurality of exhaust manifold sections may enable effluent from different combustion chambers to be directed to different locations in the engine system. Each combustion chamber, such as combustion chamber 30, may be supplied one or more fuels, such as gasoline, alcohol fuel blends, diesel, biodiesel, compressed natural gas, etc., via a respective fuel injector, such as fuel injector 66 (shown coupled to combustion chamber 30). Fuel may be supplied to the combustion chambers via direct injection, port injection, throttle valve-body injection, or any combination thereof. In the combustion chambers, combustion may be initiated via spark ignition and/or compression ignition.

Exhaust from the one or more exhaust manifold sections may be directed to turbine 116 to drive the turbine. When reduced turbine torque is desired, a portion of the exhaust gas from engine 10 may be directed instead through wastegate 92, bypassing the turbine. In some examples, all of the exhaust gas from engine 10 may be directed through wastegate 92 via bypass passage 90. The combined flow from the turbine 116 and the wastegate 92 may then flow through emission control device (ECD) 171. In some examples, the engine system 100 may include an additional emission control device positioned downstream of ECD 171. The ECD 171 may include one or more exhaust after-treatment catalysts configured to catalytically treat the exhaust flow, and thereby reduce an amount of one or more substances in the exhaust flow. For example, one exhaust after-treatment catalyst may be configured to trap NOx from the exhaust flow when the exhaust flow is lean, and to reduce the trapped NOx when the exhaust flow is rich. In other examples, an exhaust after-treatment catalyst may be configured to disproportionate NOx or to selectively reduce NOx with the aid of a reducing agent. In still other examples, an exhaust after-treatment catalyst may be configured to oxidize residual hydrocarbons and/or carbon monoxide in the exhaust flow. Different exhaust after-treatment catalysts having any such functionality may be arranged in wash coats or elsewhere in the exhaust after-treatment stages, either separately or together. In some embodiments, the exhaust after-treatment stages may include a regeneratable soot filter configured to trap and oxidize soot particles in the exhaust flow.

All or part of the treated exhaust from ECD 171 may be released into the atmosphere via exhaust conduit 35. Depending on operating conditions, however, a portion of the exhaust residuals may be diverted instead to EGR passage 150, through EGR cooler 151 and EGR valve 152, and to the inlet of compressor 114. EGR passage 150 may be positioned upstream of ECD 171, in some examples. In the depicted example, EGR passage 150 is shown fluidly coupled to the inlet of compressor 114. In other examples, EGR passage 150 may be arranged differently and/or engine system 100 may include additional EGR passages which may be arranged differently relative to EGR passage 150. EGR passage 150 is configured as a low pressure EGR passage coupling the engine exhaust manifold, downstream of the turbine 116, with the engine intake manifold, upstream of compressor 114. In some examples, engine system 100 may additionally or optionally include a high pressure EGR system coupling the engine exhaust manifold, upstream of the turbine 116, with the engine intake manifold, downstream of compressor 114.

EGR valve 152 may be opened to admit a controlled amount of cooled exhaust gas to the compressor inlet for desirable combustion and emissions-control performance. In this way, engine system 10 is adapted to provide external, low-pressure (LP) EGR by tapping exhaust gas from downstream of turbine 116. In some examples, EGR valve 152 is a continuously variable valve, and in other examples, EGR valve 152 is an on/off valve. The rotation of the compressor 114, in addition to the LP-EGR flow path in engine system 10, may provide homogenization of the exhaust gas into the intake air charge. Further, the disposition of EGR take-off and mixing points may provide cooling of the exhaust gas for increased available EGR mass and increased engine performance.

EGR cooler 151 may be coupled to EGR passage 150 for cooling EGR delivered to the compressor 114. In addition, one or more sensors may be coupled to EGR passage 150 for providing details to control system 14 regarding the composition and condition of the EGR (e.g., measuring and/or estimating the composition and/or condition of the EGR gas). For example, a temperature sensor may be provided for determining a temperature of the EGR, a pressure sensor may be provided for determining a temperature of the EGR, a humidity sensor may be provided for determining a humidity or water content of the EGR, and an air-fuel ratio sensor 154 may be provided for estimating an air-fuel ratio of the EGR. Alternatively, EGR conditions may be inferred by the one or more temperature, pressure, humidity and air-fuel ratio sensors 55-57 coupled to the compressor inlet. An opening of the EGR valve may be adjusted based on the engine operating conditions and the EGR conditions to provide a desired amount of engine intake air dilution (e.g., mixing of intake air with exhaust gas).

Engine system 100 further includes control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, MAP sensor 124, exhaust temperature sensor 128, exhaust pressure sensor 129, compressor inlet temperature sensor 55, compressor inlet pressure sensor 56, compressor inlet humidity sensor 57, and air-fuel ratio sensor 154. Other sensors such as additional pressure, temperature, air/fuel ratio, and composition sensors may be coupled to various locations in engine system 100. The actuators 81 may include, for example, throttle 20, EGR valve 152, wastegate 92, and fuel injector 66. The control system 14 includes an electronic controller 12. The controller 12 may receive input data from the various sensors, process the input data, and trigger various actuators in response to the processed input data based on instruction or code programmed therein corresponding to one or more routines.

In some examples, engine system 100 may be included in a hybrid vehicle with multiple sources of torque available to one or more vehicle wheels. For example, torque may be provided to the vehicle wheels via an output of engine 10, and during some conditions, an electric machine (e.g., electric motor) may provide torque to the vehicle wheels in addition to (or instead of) torque provided to the wheels by engine 10. The electric machine may be a motor or a motor/generator, in some examples. A crankshaft of the engine 10 and the electric machine may be connected via a transmission to the vehicle wheels when one or more clutches are engaged. For example, a first clutch may be provided between the crankshaft and the electric machine, and a second clutch may be provided between the electric machine and the transmission. Controller 12 may send a signal to an actuator of each clutch to engage or disengage the clutch, so as to connect or disconnect the crankshaft from the electric machine and the components connected thereto, and/or connect or disconnect the electric machine from the transmission and the components connected thereto. The transmission may be a gearbox, a planetary gear system, or another type of transmission. The powertrain may be configured in various manners including as a parallel, a series, or a series-parallel hybrid vehicle. The electric machine may receive electrical power from a traction battery to provide torque to the vehicle wheels, in some examples. The electric machine may also be operated as a generator to provide electrical power to charge the traction battery, for example, during a braking operation.

The engine 10 includes cylinder head 103 configured to cap the combustion chambers 30 of the engine. The cylinder head 103 may be coupled (e.g., mounted) to a block of the engine 10 (e.g., an engine block) via a plurality of fasteners, which may be referred to herein as head bolts. The cylinder head 103 is configured to receive a removable camshaft carrier 105. The camshaft carrier 105 is coupled to the cylinder head 103 at a first end 107 of the cylinder head 103, opposite to a second end 109. While the camshaft carrier 105 is coupled to the cylinder head 103, the camshaft carrier 105 forms at least a portion of an exterior wall 117 of the cylinder head 103 at the first end 107. In particular, the cylinder head 103 may include a recess arranged at the exterior wall 117, and the camshaft carrier 105 may be inserted into the recess and seat against a mount surface formed by the cylinder head 103 within the recess in order form the portion of the exterior wall 117 and separate an interior of the cylinder head 103 from an exterior of the cylinder head 103. The exterior wall 117 may be an outermost wall of the cylinder head 103 (e.g., a wall defining an interior volume or cavity of the cylinder head 103).

The camshaft carrier 105 is shaped to support at least one camshaft journal, such as the camshaft journal 111 and/or the camshaft journal 113. As one example, the camshaft journal 111 may be supported by the camshaft carrier 105 at the first end 107, with the camshaft journal 111 extending across the cylinder head 103 from the first end 107 to the second end 109. While the camshaft journal 111 is supported by the camshaft carrier 105, the camshaft journal 111 may be driven to rotate within the camshaft carrier 105 by the engine 10 (e.g., to open and/or close one or more intake valves or exhaust valves of the engine via engagement of the valves with cams coupled to the camshaft journal 111). By configuring the camshaft carrier 105 to form the portion of the exterior wall 117 of the cylinder head 103 and to removably couple to the cylinder head 103, an overall size of the cylinder head 103 may be reduced which may reduce a cost of the engine system 100, increase an ease of manufacturing of the engine system 100, and/or increase an ease of maintenance of the cylinder head 103.

Turning now to FIGS. 2-8, an example of a cylinder head 202 according to the present disclosure is shown. The cylinder head 202 may be included within an engine system, such as the engine system 100 shown by FIG. 1 and described above. In some examples, the cylinder head 202 may be similar to, or the same as, the cylinder head 103 described above with reference to FIG. 1. Additionally, FIGS. 2-8 show a camshaft carrier 230 removably couplable with the cylinder head 202. In some examples, the camshaft carrier 230 may be similar to, or the same as, the camshaft carrier 105 described above with reference to FIG. 1.

Referring to FIG. 2, a perspective view of an engine 200 is shown. The engine 200 includes cylinder head 202 and removable camshaft carrier 230. The camshaft carrier 230 is removably couplable to the cylinder head 202. In particular, the camshaft carrier 230 may be fixed, or mounted, to the cylinder head 202, or may be removed from the cylinder head 202 (e.g., for maintenance of the cylinder head 202 and/or camshaft carrier 230). In the view shown by FIG. 2, the cylinder head 202 is shown decoupled from engine block 204 and spaced apart from the engine block 204. Engine block 204 includes a plurality of combustion chambers (e.g., combustion chamber 234). The combustion chambers (which may be referred to herein as cylinders) are capped by the cylinder head 202 during conditions in which the cylinder head 202 is coupled to the engine block 204 (e.g., the cylinder head 202 forms an upper cap portion of each combustion chamber).

The cylinder head 202 is configured to mount directly to the engine block 204 via a plurality of head bolts inserted through the cylinder head 202 and into the engine block 204. For example, FIG. 2 shows a first head bolt 206 and a second head bolt 208 arranged at a first end 218 of the cylinder head 202. In particular, although the cylinder head 202 may be coupled to the engine block 204 via additional head bolts (e.g., head bolts other than the first head bolt 206 and the second head bolt 208), the first head bolt 206 and the second head bolt 208 are arranged closest to the first end 218 of the cylinder head 202 relative to each other head bolt (e.g., no other head bolts coupling the cylinder head 202 to the engine block 204 are positioned closer to the first end 218 than the first head bolt 206 and the second head bolt 208). The first end 218 is an end of the cylinder head that does not include intake ports, exhaust ports, an intake manifold, an exhaust manifold, etc. For example, the first end 218 may be configured to include a front end accessory drive (FEAD) of the engine 200, where a first side 270 of the cylinder head 202 perpendicular to the first end 218 is configured to include intake ports (such as intake port 274), and an opposing second side 272 is configured to include exhaust ports (such as exhaust port 300, shown by FIG. 3), or vice versa (e.g., in other examples the first side 270 may include exhaust ports and the second side 272 may include intake ports). As another example, the first end 218 may be an end opposite to the FEAD. The first head bolt 206 may be inserted through a mount opening 252 formed in a mount surface 254 (which may be referred to herein as a lower mount surface) and through a first opening 214 of the engine block 204 along axis 210, and the second head bolt 208 may be inserted through a mount opening 256 formed in a mount surface 258 (which may be referred to herein as a lower mount surface) and through a second opening 216 of the engine block 204 along axis 212. During conditions in which the first head bolt 206 couples the cylinder head 202 to the engine block 204, the first head bolt 206 is positioned directly in engagement with the mount surface 254, and during conditions in which the second head bolt 208 couples the cylinder head 202 to the engine block 204, the second head bolt 208 is positioned directly in engagement with the mount surface 258 (e.g., directly in face-sharing contact, with no other components arranged therebetween). In some examples, one or both of the first opening 214 and second opening 216 may include threads configured to engage with counterpart threads of the first head bolt 206 and second head bolt 208, respectively. The cylinder head 202 includes an exterior wall 232 arranged at the first end 218 of the cylinder head 202. The exterior wall 232 is an outermost wall of the cylinder head 202 and separates an interior 236 of the cylinder head 202 from an exterior 238 of the cylinder head 202. The camshaft carrier 230 is adapted to form a portion of exterior wall 232 (which may be referred to herein as an exterior end wall) of the cylinder head 202 during conditions in which the camshaft carrier 230 is coupled to the cylinder head 202. In particular, the camshaft carrier 230 acts as an extension of the exterior wall 232 while the camshaft carrier 230 is coupled to the exterior wall 232. The coupling of the camshaft carrier 230 to the exterior wall 232 increases a separation of the interior 236 of the cylinder head 202 from the exterior 238 of the cylinder head 202. Specifically, during conditions in which the camshaft carrier 230 is not coupled to the exterior wall 232, the interior 236 of the cylinder head 202 is separated from the exterior 238 of the cylinder head 202 by the exterior wall 232 at the first end 218, and during conditions in which the camshaft carrier 230 is coupled to the exterior wall 232, the interior 236 of the cylinder head 202 is additionally separated from the exterior 238 of the cylinder head 202 by the camshaft carrier 230.

The camshaft carrier 230 is shaped to support at least one camshaft journal, such as camshaft journal 240 and/or camshaft journal 242. While supported by the camshaft carrier 230, each camshaft journal may extend across the cylinder head 202 from the first end 218 to an opposing second end 220. The cylinder head 202 may include one or more support surfaces configured to maintain the position of the camshaft journals across the cylinder head 202, such as support surface 244 fixed to the cylinder head 202 via fasteners 248, support surface 246 fixed to the cylinder head 202 via fasteners 250, etc. However, because the camshaft carrier 230 is arranged at the first end 218 during conditions in which the camshaft carrier 230 is coupled to the exterior wall 232 and closes a portion of the exterior wall 232, the camshaft carrier 230 is arranged closer to the head bolts at the first end (e.g., first head bolt 206 and second head bolt 208) than any of the support surfaces (e.g., each support surface, such as support surface 244, support surface 246, etc., is positioned a further distance from the head bolts at the first end in comparison with the camshaft carrier 230). In particular, the camshaft carrier 230 is configured to be coupled to the cylinder head 202 at a location directly vertically above the head bolts at the first end 218 (e.g., vertically relative to the engine block 204, where the engine block 204 is arranged vertically below the cylinder head 202 during conditions in which the cylinder head 202 is coupled to the engine block 204), as described further below. The arrangement of the camshaft carrier 230 directly above the head bolts at the first end 218 (and, correspondingly, directly above the mount surface 254 and mount surface 258) may reduce a length of the cylinder head 202 and engine 200 relative to configurations that do not include this configuration, which may reduce a cost and/or packaging complexity of the engine 200.

The camshaft carrier 230 includes an upper, first section 260 and a lower, second section 262. The first section 260 is configured to removably couple to the second section 262 (e.g., via fastener 317, fastener 319, and fastener 321 inserted through both of the first section 260 and second section 262). While coupled together, the first section and the second section form openings (e.g., first opening 264 and second opening 266), with each opening shaped to receive a respective camshaft journal (e.g., camshaft journal 240 or camshaft journal 242, respectively). Enclosing the camshaft journals within the camshaft carrier 230 and supporting the camshaft journals via the camshaft carrier 230 may include coupling the lower, second section 262 to the cylinder head 202, seating the camshaft journals within the respective bearing portions of the second section 262, and coupling the first section 260 to the second section 262, around the camshaft journals.

Referring to FIG. 3, a bottom perspective view of the cylinder head 202 is shown. The cylinder head 202 includes a bottom surface 303 configured to engage in direct face-sharing contact with an upper surface 276 of the engine block 204 (shown by FIG. 2). The first head bolt 206 and second head bolt 208 may each extend outward from the bottom surface 303 to couple with the engine block 204. In the view shown by FIG. 3, portions of the cylinder head 202 configured to cap the combustion chambers of the engine 200 are shown. In particular, cylinder head includes cylinder cap surface 307 configured to cap combustion chamber 234 (shown by FIG. 2), with an intake valve seat 309 and an exhaust valve seat 311. Additionally, in the view shown by FIG. 3, other head bolts configured to couple the cylinder head 202 to the engine block 204 are shown, such as head bolt 310 and head bolt 312. However, the head bolt 206 and the head bolt 208 are arranged closer to the first end 218 than each other head bolt. For example, head bolt 310 is positioned further from the first end 218 compared to head bolt 206, and head bolt 312 is positioned further from the first end 218 compared to head bolt 208.

Figure 4:
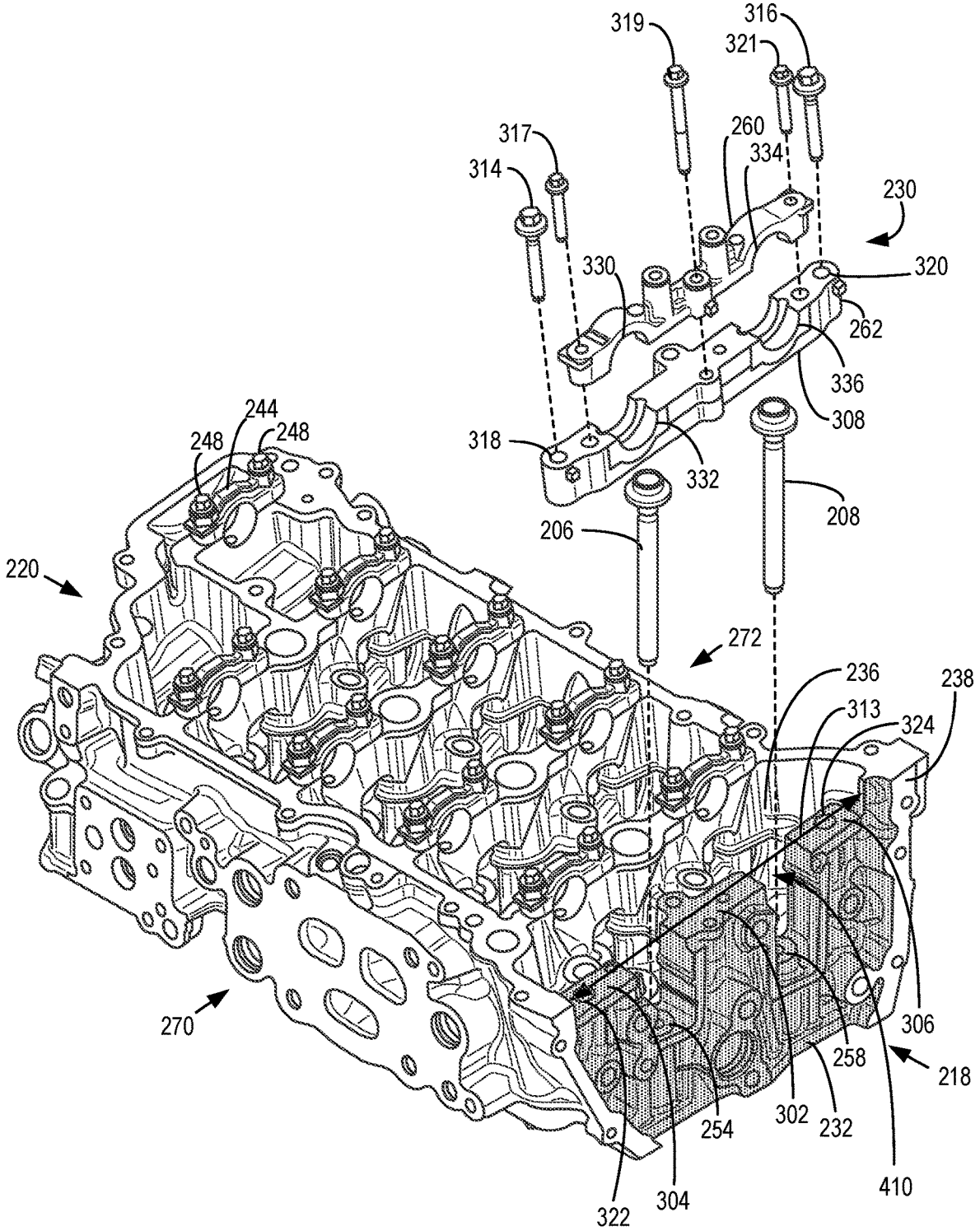
FIG. 4 shows a perspective view of the cylinder head of FIGS. 2-3 with the camshaft carrier removed.

Referring to FIG. 4, a perspective view of the cylinder head 202 is shown, with the camshaft carrier 230 removed from the cylinder head 202.

The cylinder head 202 includes a plurality of mount surfaces configured to engage directly in face-sharing contact with a bottom surface 308 of the second section 262 of the camshaft carrier 230. In particular, cylinder head 202 includes mount surface 302, mount surface 304, and mount surface 306 each formed by the exterior wall 232 and arranged within recess 410 (which may be referred to herein as a clearance) formed by the exterior wall 232 (with a length 313 of the recess 410 in a direction from the first side 270 of the cylinder head 202 to the second side 272 of the cylinder head 202 indicated by a double-headed arrow). In the view shown by FIG. 4, the exterior wall 232 is indicated by a stipple shading pattern. During conditions in which the camshaft carrier 230 is coupled to the cylinder head 202, the camshaft carrier 230 is positioned directly against each of the mount surface 302, mount surface 304, and mount surface 306 (which may each be referred to herein as upper mount surfaces, whereas mount surface 254 and mount surface 258 may be referred to herein as lower mount surfaces, with the lower mount surfaces configured to be offset, or spaced away from and not in direct contact with, the camshaft carrier 230 when the camshaft carrier 230 is coupled to the cylinder head 202). The upper mount surfaces are coplanar with each other (e.g., parallel to each other, with each arranged along a same plane), and may be referred to herein as coplanar mount surfaces.

As described above, the camshaft carrier 230 is removably couplable to the cylinder head 202, and correspondingly the camshaft carrier 230 is configured to seat within the recess 410 and couple to (e.g., fixedly seat against) each of the mount surface 302, mount surface 304, and mount surface 306 arranged within the recess 410 during conditions in which the camshaft carrier 230 is coupled to the cylinder head 202. During conditions in which the camshaft carrier 230 is removed from the cylinder head 202 (e.g., for maintenance), the camshaft carrier 230 may be disengaged from each of the upper mount surfaces. While coupled to the upper mount surfaces formed by the exterior wall 232 of the cylinder head 202 (e.g., mount surface 302, mount surface 304, and mount surface 306), the camshaft carrier 230 seats directly against the upper mount surfaces and may be fixed to one or more of the upper mount surfaces by one or more fasteners. For example, the camshaft carrier 230 may be fixed to the mount surface 304 and mount surface 306 by fastener 314 and fastener 316, respectively. In particular, fastener 314 may be inserted through a passage 318 formed through the second section 262 of the camshaft carrier 230 and into a corresponding opening 322 formed in the mount surface 304, and fastener 316 may be inserted through a passage 320 formed through the second section 262 and into a corresponding opening 324 formed in the mount surface 306. During conditions in which the camshaft carrier 230 is fixedly coupled to the upper mount surfaces of the exterior wall 232 as described above, the camshaft carrier 230 closes at least a portion of the recess 410 of the exterior wall and further separates interior 236 of the cylinder head 202 from exterior 238 of the cylinder head 202.

The first section 260 of the camshaft carrier 230 includes a first bearing portion 330, and the second section 262 of the camshaft carrier 230 includes a second bearing portion 332. While the second section 262 is coupled to the first section 260, the first bearing portion 330 and the second bearing portion 332 together form first opening 264 (shown by FIGS. 2 and 5) shaped to receive a camshaft journal (e.g., camshaft journal 24). The camshaft journal 240 may be seated within the second bearing portion 332 of the second section 262, and may be enclosed within the camshaft carrier 230 by coupling the first section 260 to the second section 262 around the camshaft journal 240. In this configuration, the camshaft journal 240 is enclosed by the first bearing portion 330 and the second bearing portion 332.

Figure 5:
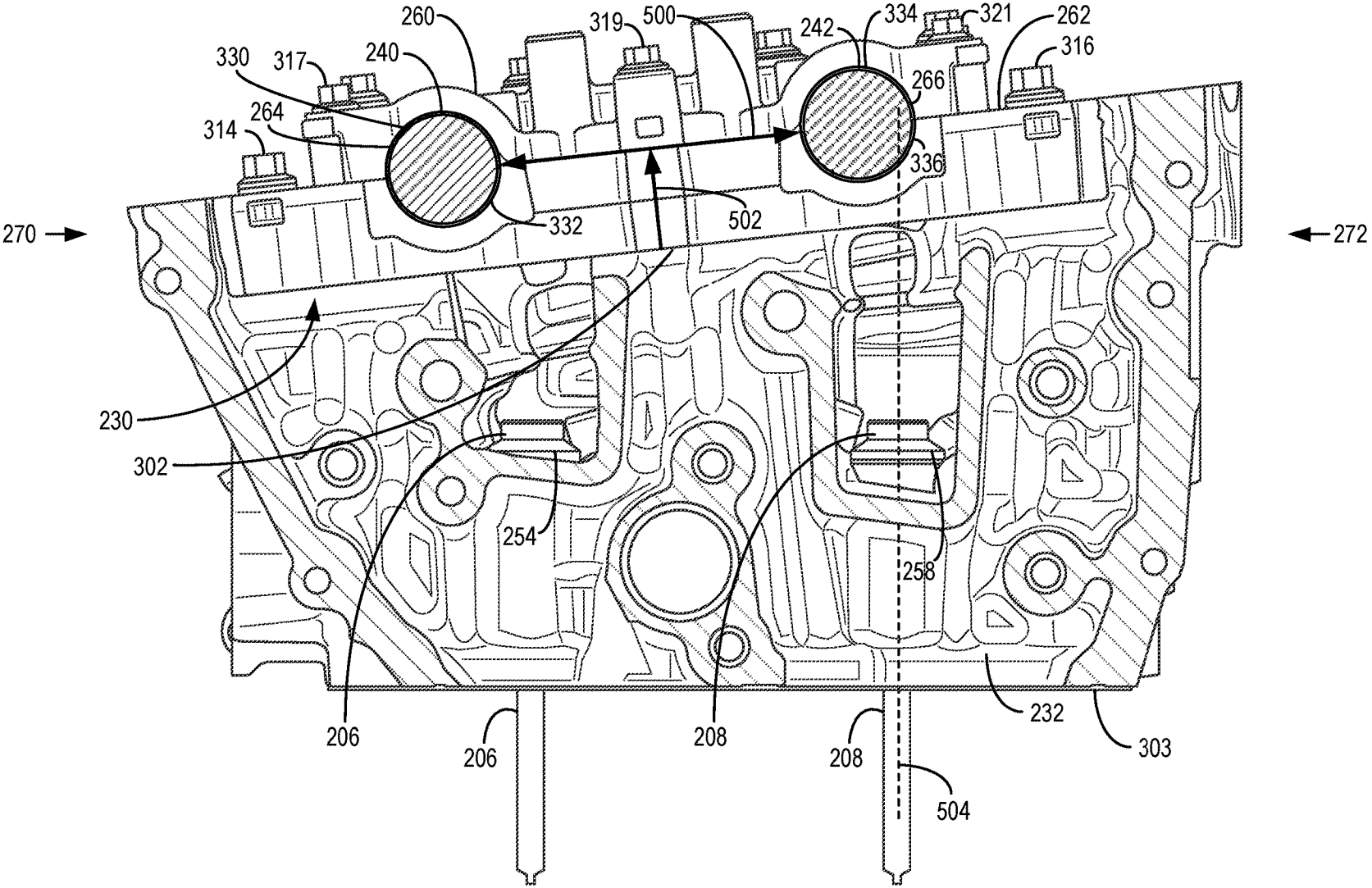
FIG. 5 shows a side view of the cylinder head of FIGS. 2-4 with the camshaft carrier coupled to the exterior wall.

The first section 260 of the camshaft carrier 230 additionally includes a third bearing portion 334, and the second section 262 of the camshaft carrier 230 additionally includes a fourth bearing portion 336. While the second section 262 is coupled to the first section 260, the third bearing portion 334 and the fourth bearing portion 336 together form second opening 266 (shown by FIGS. 2 and 5) shaped to receive a second camshaft journal (e.g., camshaft journal 242 described above). The second opening 266, as shown by FIG. 5, is spaced apart from the first opening 264 in a direction 500 orthogonal to a normal 502 (e.g., normal direction) of the mount surface 302. Similar to the example described above, the second camshaft journal may be seated within the fourth bearing portion 336 of the second section 262, and may be enclosed within the camshaft carrier 230 by coupling the first section 260 to the second section 262 around the second camshaft journal 242. In this configuration, the second camshaft journal 242 is enclosed by the third bearing portion 334 and the fourth bearing portion 336.

Referring to FIG. 5, a side view of the cylinder head 202 is shown, with the camshaft carrier 230 coupled to exterior wall 232. In this configuration, the camshaft carrier 230 is arranged directly vertically overhead (e.g., above) the head bolt 208 and the mount surface 258, as indicated by axis 504 extending parallel along a center of the head bolt 208 and intersecting the camshaft carrier 230. Similarly, the camshaft carrier 230 is positioned directly vertically overhead the head bolt 206 and mount surface 254. In particular, during conditions in which the camshaft carrier 230 is coupled to the cylinder head 202 and includes the camshaft journal 242 supported within the opening 266, the camshaft journal 242 is arranged directly vertically overhead the head bolt 208 and the mount surface 258, as indicated by axis 504 intersecting the camshaft journal 242. Thus, the camshaft carrier 230 is configured to mount directly to the cylinder head 202 in-line with each of the lower mount surfaces (e.g., mount surface 254 and mount surface 258) in a normal direction of each lower mount surface (e.g., the direction of axis 504).

Figure 6:
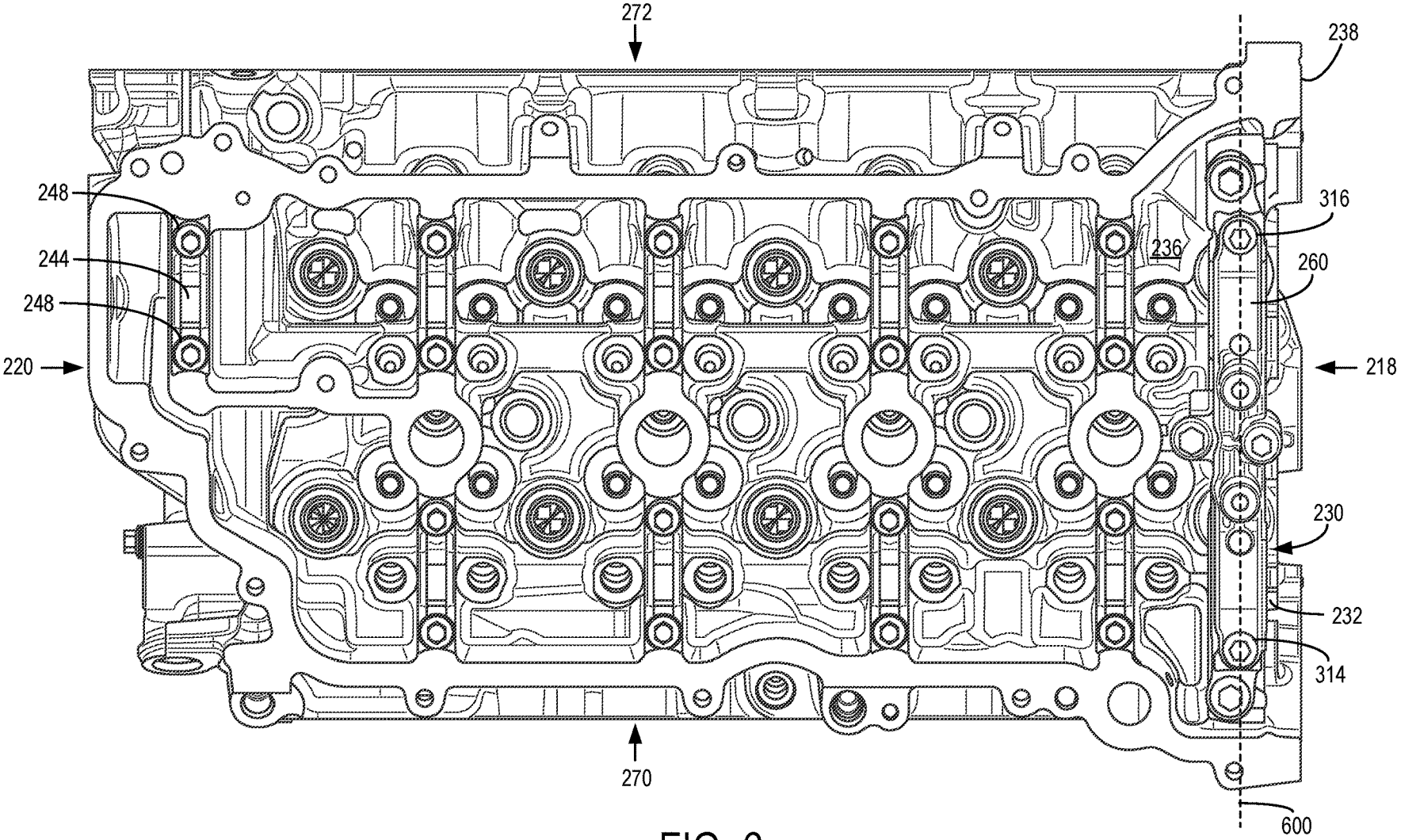
FIG. 6 shows a top view of the cylinder head of FIGS. 2-5 with the camshaft carrier coupled to the exterior wall.

Referring to FIG. 6, a top view of the cylinder head 202 is shown, with the camshaft carrier 230 coupled to the exterior wall 232. Axis 600 is shown extending across the camshaft carrier 230, where each of the fasteners coupling the camshaft carrier 230 to the cylinder head 202 are arranged in-line along the axis 600. In particular, fastener 314 and fastener 316 are each arranged along the axis 600. Although not shown by FIG. 6, the upper mount surfaces (e.g., mount surface 302, mount surface 304, and mount surface 306) are each aligned in the direction of the axis 600.

Figure 7:
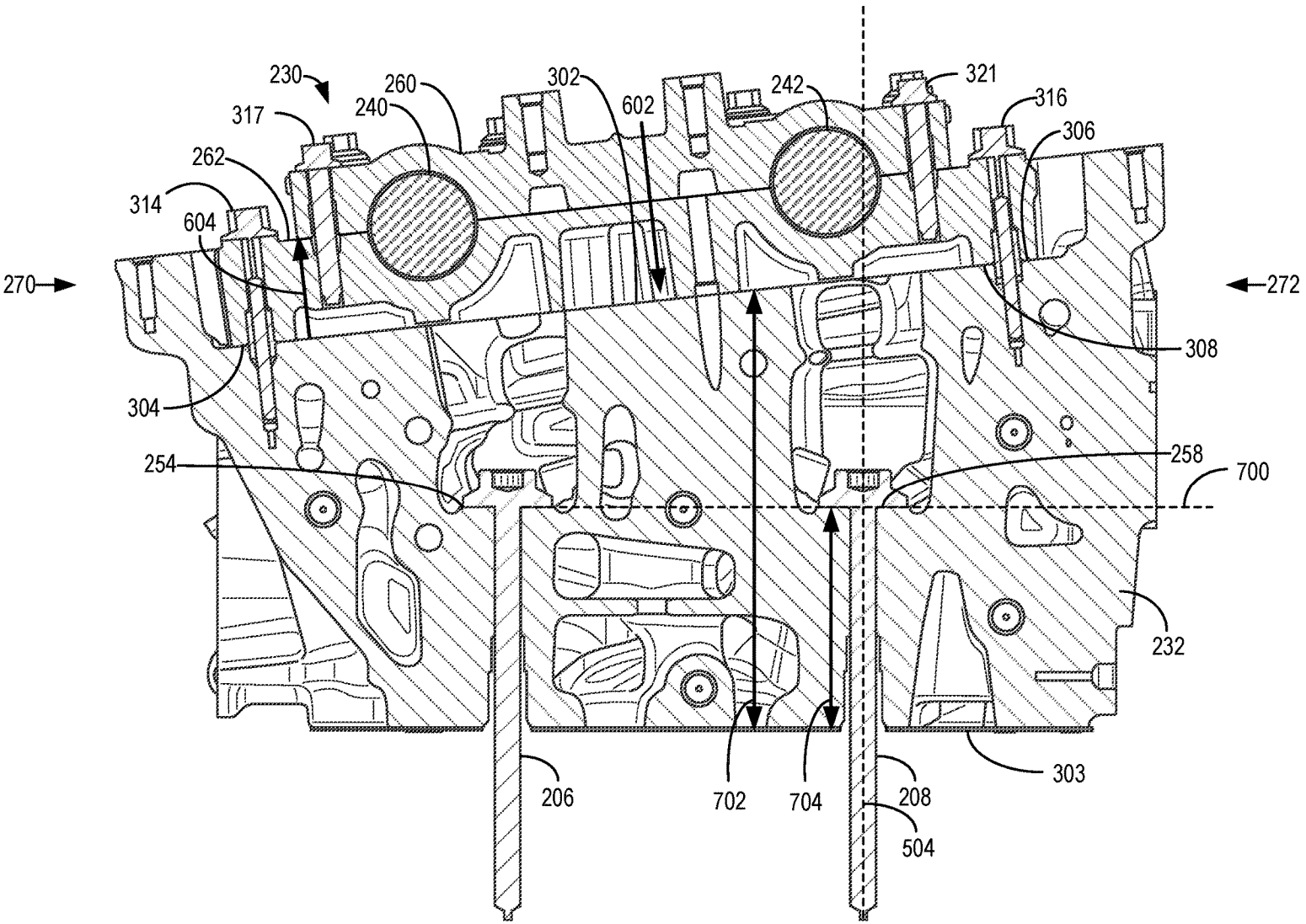
FIG. 7 shows a side cross-sectional view of the cylinder head of FIGS. 2-6 with the camshaft carrier coupled to the exterior wall.

Referring to FIG. 7, a side cross-sectional view of the cylinder head 202 is shown, with the camshaft carrier 230 coupled to the exterior wall 232. The cross-sectional view of cylinder head 202 is taken along the axis 600 shown by FIG. 6. As described above, axis 504 is arranged normal to the mount surface 258 and intersects the camshaft carrier 230. An axis 700, perpendicular to the axis 504, is shown by FIG. 7 intersecting each of the lower mount surfaces (e.g., mount surface 254 and mount surface 258). In particular, both of the lower mount surfaces are coplanar relative to each other, and each are arranged in-line with the axis 700.

Each of the upper mount surfaces (e.g., mount surface 302, mount surface 304, and mount surface 306) and each of the lower mount surfaces (e.g., mount surface 254 and mount surface 258) are arranged at a terminal end 602 of the recess 410 formed by the exterior wall 232, where the terminal end 602 is formed by the exterior wall 232 and is opposite to an open end 604 of the recess 410. During conditions in which the camshaft carrier 230 is seated against the upper mount surfaces (e.g., mount surface 302, mount surface 304, and mount surface 306), the camshaft carrier 230 may extend through the open end 604 of the recess 410 and may partially protrude from the open end 604. In this configuration, the camshaft carrier 230 may support the camshaft journals (e.g., camshaft journal 240 and camshaft journal 242) at the open end 604 (e.g., with the camshaft journals at least partially extending from the open end 604). However, in other examples, the camshaft journals may be arranged extending through the recess 410 without extending out from the open end 604.

A length 702 between the mount surface 302 (e.g., the surface configured to engage directly with the camshaft carrier 230) and the bottom surface 303 the cylinder head 202 configured to mount directly to the engine block 204 (with the engine block 204 shown by FIG. 2) is greater than a length 704 between either of the lower mount surfaces (e.g., mount surface 254 or mount surface 258) and the bottom surface 303 of the cylinder head 202 (which may be referred to herein as an end of the cylinder head 202), in the normal direction of the lower mount surfaces (e.g., the direction parallel to axis 504). In this configuration, the head bolts (e.g., head bolt 206 and head bolt 208) may be arranged closer to the engine block 204 due to the reduced length 704 between the lower mount surfaces and the bottom surface 303 of the cylinder head 202, which may increase an ease of assembly of the engine.

Figure 8:
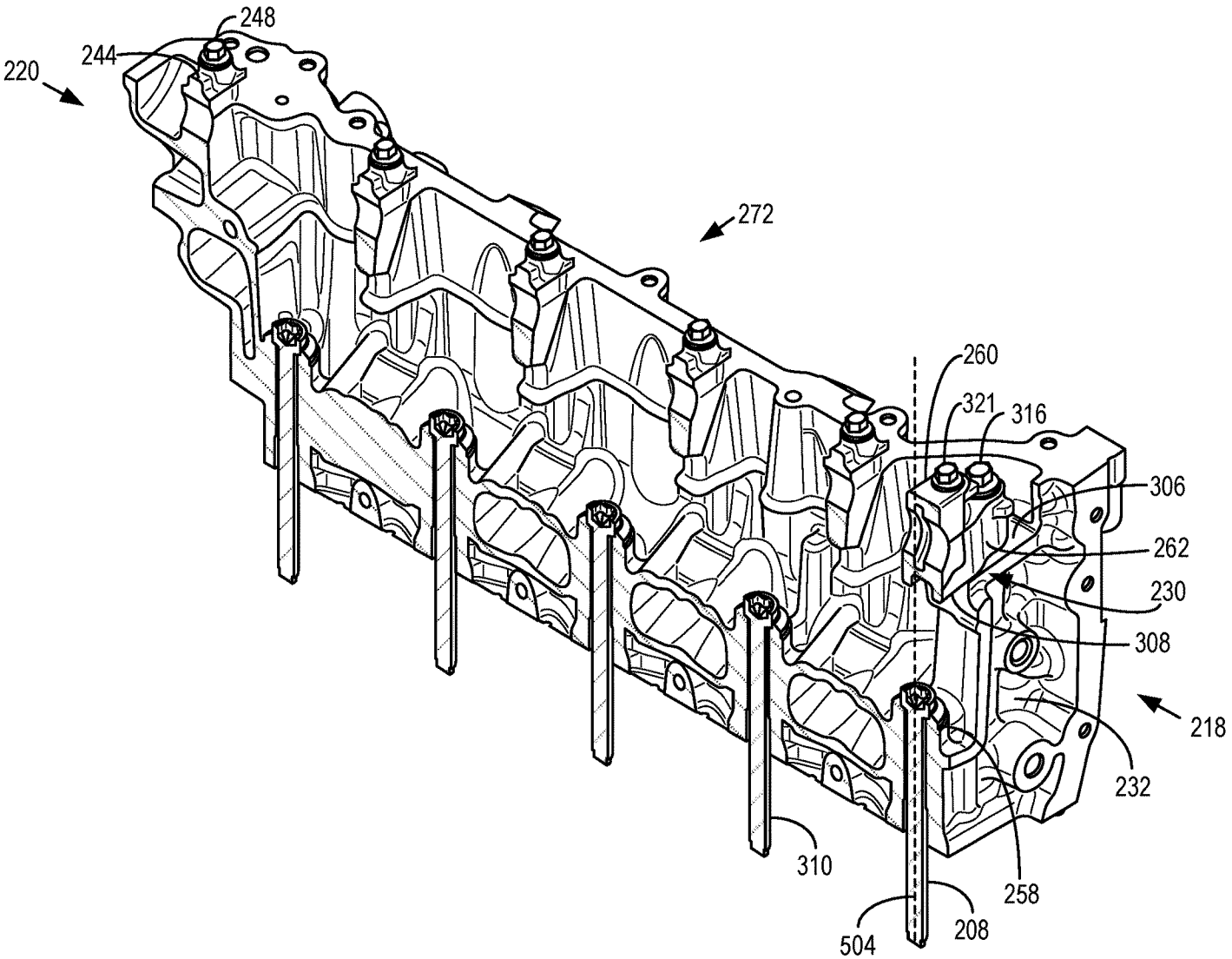
FIG. 8 shows a perspective cross-sectional view of the cylinder head of FIGS. 2-7 with the camshaft carrier coupled to the exterior wall.

Referring to FIG. 8, a perspective cross-sectional view of the cylinder head 202 is shown, with the camshaft carrier 230 coupled to the exterior wall 232. As described above, the camshaft carrier 230 mounts directly overhead the head bolts arranged closest to the first end 218 of the cylinder head 202. In particular, the head bolt 208 mounted to the mount surface 258 is positioned vertically in-line with camshaft journal 242 (shown by FIG. 7) during conditions in which the camshaft carrier 230 is coupled to the cylinder head 202 and the camshaft journal 242 is supported by the camshaft carrier 230. As indicated by FIG. 8, the axis 504 normal to the mount surface 258 intercepts the opening 266 formed by the third bearing portion 334 and the fourth bearing portion 336, with the camshaft journal 242 configured to seat within the opening 266.

Figure 9:
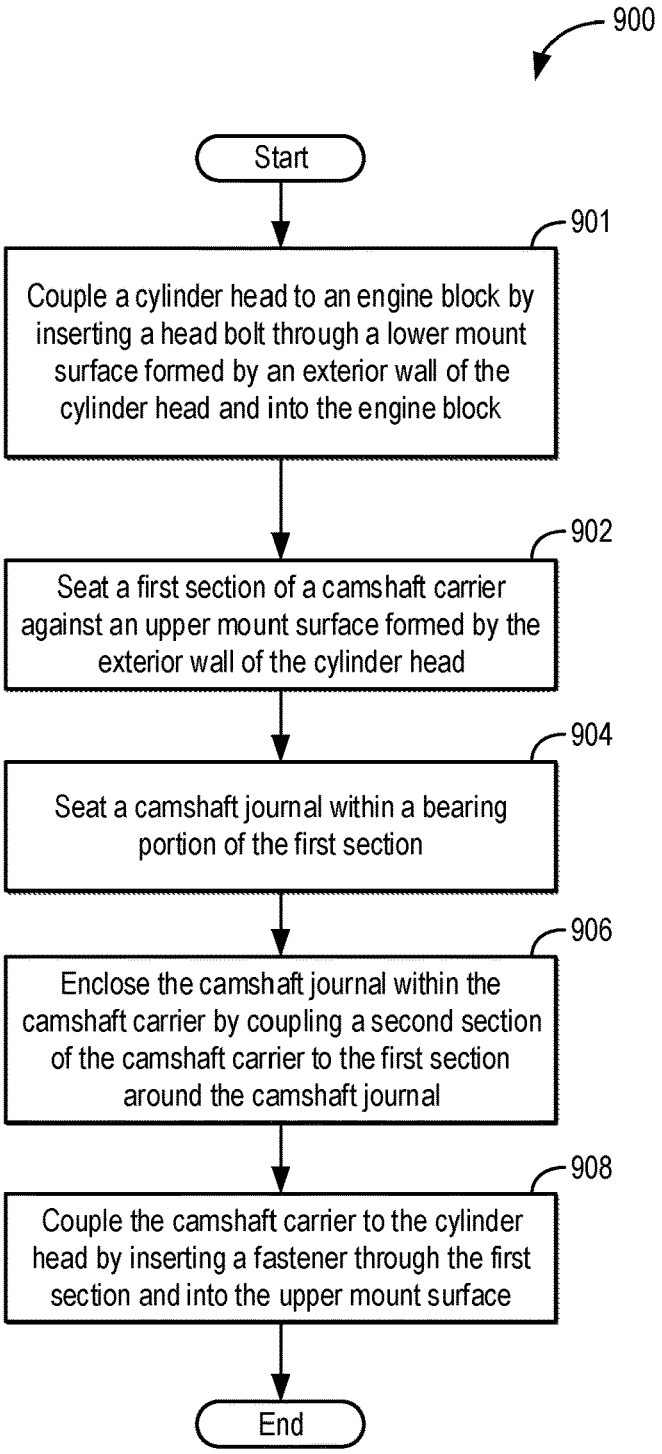
FIG. 9 shows a flow chart illustrating a method for assembling a removable camshaft carrier with a cylinder head and engine block.

Referring to FIG. 9, a flow chart is shown illustrating a method 900 for assembling a removable camshaft carrier with a cylinder head and engine block. In some examples, the removable camshaft carrier may be similar to, or the same as, the camshaft carrier 230 described above with reference to FIGS. 2-8 and/or the camshaft carrier 105 described above with reference to FIG. 1. The cylinder head may be similar to, or the same as, the cylinder head 202 described above with reference to FIGS. 2-8 and/or the cylinder head 103 described above with reference to FIG. 1. The engine block may be similar to, or the same as, the engine block 204 described above with reference to FIG. 2.

At 901, the method includes coupling the cylinder head to the engine block by inserting a head bolt through a lower mount surface formed by an exterior wall of the cylinder head and into the engine block. The head bolt may be similar to, or the same as, the head bolt 206 and/or head bolt 208 described above. The lower mount surface may be similar to, or the same as, the mount surface 254 and/or mount surface 258 described above (e.g., the lower mount surfaces arranged closest to the exterior wall of the cylinder head). The exterior wall may be similar to, or the same as, the exterior wall 232 described above with reference to FIGS. 2-8 and/or the exterior wall 117 described above with reference to FIG. 1.

At 902, the method includes seating a first section of the camshaft carrier against an upper mount surface formed by the exterior wall of the cylinder head. The first section may be similar to, or the same as, the second section 262 described above with reference to FIGS. 2-8, and the upper mount surface may be similar to, or the same as, the mount surface 302 described above. The first section may be seated in direct, face-sharing contact with the upper mount surface (e.g., with no other components positioned therebetween).

Seating the first section of the camshaft carrier against the upper mount surface may include positioning the camshaft carrier through an open end of the exterior wall and within a recess formed by the exterior wall, where the upper mount surface is arranged at a terminal end of the recess. The recess, open end, and terminal end may be similar to, or the same as, the recess 410, open end 604, and terminal end 602, respectively, described above with reference to FIG. 7.

Positioning the first section within the recess formed by the exterior wall may close at least a portion of the exterior wall separating an interior and exterior of the cylinder head, similar to the examples described above. The interior and exterior of the cylinder head may be similar to, or the same as, the interior 236 and exterior 238 described above. In particular, the first section may act as an extension of the exterior wall during conditions in which the first section is coupled to (e.g., seated against) the upper mount surface. Additionally, with the second section coupled to the first section, the amount of extension of the exterior wall may be increased, which may further separate the interior and exterior of the cylinder head.

At 904, the method includes seating a camshaft journal within a bearing portion of the first section. The camshaft journal may be the same as, or similar to, the camshaft journal 240 or camshaft journal 242 described above. The bearing portion may be similar to, or the same as, the second bearing portion 332 or fourth bearing portion 336 described above.

At 906, the method includes enclosing the camshaft journal within the camshaft carrier by coupling a second section of the camshaft carrier to the first section around the camshaft journal. Coupling the second section of the camshaft carrier to the first section may include inserting one or more fasteners through both of the second section and first section, similar to the fastener 317, fastener 319, and/or fastener 321 described above.

At 908, the method includes coupling the camshaft carrier to the cylinder head by inserting a fastener through the first section and the upper mount surface. The fastener inserted through the first section and the upper mount surface may be similar to, or the same as, the fastener 314 and/or the fastener 316 described above.

By configuring the camshaft carrier to couple to the cylinder head and form at least a portion of the exterior wall of the cylinder head, a length of the engine may be reduced. In this way, the head bolts coupling the cylinder head to the engine block may be arranged at the exterior wall, and the camshaft carrier may be decoupled from the exterior wall in order to increase access to the head bolts for maintenance and/or assembly. Additionally, the interior of the cylinder head may be more easily accessed for maintenance and/or assembly. The reduced length of the engine may decrease a cost and/or weight of the engine, and the reduced weight of the engine may increase engine performance. Further, the reduced length of the engine may increase an amount of space available for other engine components, which may increase an ease of manufacturing and/or maintenance.

In one embodiment, a system for an engine comprises: a cylinder head; and a camshaft carrier removably couplable to a mount surface of the cylinder head and adapted to form a portion of an exterior wall of the cylinder head while coupled to the mount surface. In a first example of the system, the mount surface is arranged at a terminal end of a recess formed by the exterior wall, with the camshaft carrier removably couplable to the mount surface within the recess. A second example of the system optionally includes the first example, and further includes wherein the recess further comprises an open end arranged opposite to the terminal end, with the camshaft carrier shaped to extend through the open end while coupled to the mount surface at the terminal end. A third example of the system optionally includes one or both of the first and second examples, and further includes wherein the camshaft carrier is shaped to support a camshaft journal at the open end. A fourth example of the system optionally includes one or more or each of the first through third examples, and further includes wherein the mount surface is one of a plurality of coplanar mount surfaces formed by the exterior wall at the terminal end of the recess, with the camshaft carrier shaped to seat against each coplanar mount surface of the plurality of coplanar mount surfaces. A fifth example of the system optionally includes one or more or each of the first through fourth examples, and further includes wherein the camshaft carrier includes a first section removably couplable with the mount surface and a second section removably couplable with the first section, where the first section includes a first bearing portion and the second section includes a second bearing portion, and while the second section is coupled to the first section, the first bearing portion and second bearing portion together form a first opening shaped to receive a first camshaft journal. A sixth example of the system optionally includes one or more or each of the first through fifth examples, and further includes wherein the first section includes a third bearing portion and the second section includes a fourth bearing portion, and while the second section is coupled to the first section, the third bearing portion and fourth bearing portion together form a second opening shaped to receive a second camshaft journal, with the second opening being spaced apart from the first opening in a direction orthogonal to a normal of the mount surface. A seventh example of the system optionally includes one or more or each of the first through fifth examples, and further includes wherein while coupled to the mount surface of the cylinder head, the camshaft carrier closes at least a portion of the exterior wall and separates an interior of the cylinder head from an exterior of the cylinder head.

In another embodiment, a system comprises: an engine block; a cylinder head configured to mount directly to the engine block and including an exterior end wall forming a clearance with a first mount surface arranged therein; and a camshaft carrier configured to seat within the clearance directly against the first mount surface. In a first example of the system, the system further comprises a second mount surface arranged within the clearance, wherein the cylinder head is configured to mount directly to the engine block via engagement of a head bolt against the second mount surface. A second example of the system optionally includes the first example, and further includes wherein the camshaft carrier is configured to mount directly to the cylinder head in-line with the second mount surface in a normal direction of the second mount surface. A third example of the system optionally includes one or both of the first and second examples, and further includes wherein a length between the first mount surface and an end of the cylinder head configured to mount directly to the engine block is greater than a length between the second mount surface and the end of the cylinder head, in a normal direction of the second mount surface. A fourth example of the system optionally includes one or more or each of the first through third examples, and further includes wherein the camshaft carrier includes an upper, first section and a lower, second section, the second section configured to removably couple to the first mount surface and the first section configured to removably couple to the second section, where, while coupled together, the first section and the second section form an opening shaped to receive a camshaft journal. A fifth example of the system optionally includes one or more or each of the first through fourth examples, and further includes wherein the camshaft carrier is configured to mount directly to the cylinder head while seated within the clearance via engagement of a fastener with the first mount surface. A sixth example of the system optionally includes one or more or each of the first through fifth examples, and further includes wherein the camshaft carrier closes at least a portion of the clearance of the exterior end wall while seated directly against the first mount surface.

In one embodiment, a method comprises: seating a first section of a camshaft carrier against a first mount surface formed by an exterior wall of a cylinder head; seating a camshaft journal within a bearing portion of the first section; and enclosing the camshaft journal within the camshaft carrier by coupling a second section of the camshaft carrier to the first section around the camshaft journal. In a first example of the method, the method further comprises coupling the camshaft carrier to the cylinder head by inserting a fastener through the first section and the first mount surface. A second example of the method optionally includes the first example, and further includes wherein seating the first section of the camshaft carrier against the first mount surface includes positioning the camshaft carrier through an open end of the exterior wall and within a recess formed by the exterior wall, where the first mount surface is arranged at a terminal end of the recess. A third example of the method optionally includes one or both of the first and second examples, and further includes wherein positioning the camshaft carrier within the recess formed by the exterior wall closes at least a portion of the exterior wall separating an interior and exterior of the cylinder head. A fourth example of the method optionally includes one or more or each of the first through third examples, and further includes coupling the cylinder head to an engine block by inserting a head bolt through the engine block and a second mount surface of the cylinder head formed within the recess at the terminal end.

FIGS. 2-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller. It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine, comprising:

a cylinder head; and a camshaft carrier removably couplable only to a mount surface arranged at a terminal end of the cylinder head and adapted to form an extension of an exterior wall of the cylinder head while coupled to the mount surface.

2. The system of claim 1, wherein the mount surface is arranged at a terminal end of a recess formed by the exterior wall, with the camshaft carrier removably couplable to the mount surface within the recess.

3. The system of claim 2, wherein the recess further comprises an open end arranged opposite to the terminal end, with the camshaft carrier shaped to extend through the open end while coupled to the mount surface at the terminal end.

4. The system of claim 3, wherein the camshaft carrier is shaped to support a camshaft journal at the open end.

5. The system of claim 2, wherein the mount surface is one of a plurality of coplanar mount surfaces formed by the exterior wall at the terminal end of the recess, with the camshaft carrier shaped to seat against each coplanar mount surface of the plurality of coplanar mount surfaces.

6. The system of claim 2, wherein the camshaft carrier includes a first section removably couplable with the mount surface and a second section removably couplable with the first section, where the first section includes a first bearing portion and the second section includes a second bearing portion, and while the second section is coupled to the first section, the first bearing portion and second bearing portion together form a first opening shaped to receive a first camshaft journal.

7. The system of claim 6, wherein the first section includes a third bearing portion and the second section includes a fourth bearing portion, and while the second section is coupled to the first section, the third bearing portion and fourth bearing portion together form a second opening shaped to receive a second camshaft journal, with the second opening being spaced apart from the first opening in a direction orthogonal to a normal of the mount surface.

8. The system of claim 1, wherein while coupled to the mount surface of the cylinder head, the camshaft carrier closes at least a portion of the exterior wall and separates an interior of the cylinder head from an exterior of the cylinder head.

9. A system, comprising:

an engine block;

a cylinder head configured to mount directly to the engine block and including an exterior end wall forming a clearance with a first mount surface arranged therein; and a camshaft carrier configured to only seat within the clearance directly against the first mount surface.

10. The system of claim 9, further comprising a second mount surface arranged within the clearance, wherein the cylinder head is configured to mount directly to the engine block via engagement of a head bolt against the second mount surface.

11. The system of claim 10, wherein the camshaft carrier is configured to mount directly to the cylinder head in-line with the second mount surface in a normal direction of the second mount surface.

12. The system of claim 10, wherein a length between the first mount surface and an end of the cylinder head configured to mount directly to the engine block is greater than a length between the second mount surface and the end of the cylinder head, in a normal direction of the second mount surface.

13. The system of claim 9, wherein the camshaft carrier includes an upper, first section and a lower, second section, the second section configured to removably couple to the first mount surface and the first section configured to removably couple to the second section, where, while coupled together, the first section and the second section form an opening shaped to receive a camshaft journal.

14. The system of claim 9, wherein the camshaft carrier is configured to mount directly to the cylinder head while seated within the clearance via engagement of a fastener through the first mount surface.

15. The system of claim 9, wherein the camshaft carrier closes at least a portion of the clearance of the exterior end wall while seated directly against the first mount surface.

16. A method, comprising:

seating a first section of a camshaft carrier only against a first mount surface formed by an exterior wall of a cylinder head;

seating a camshaft journal within a bearing portion of the first section; and enclosing the camshaft journal within the camshaft carrier by coupling a second section of the camshaft carrier to the first section around the camshaft journal, wherein the first mount surface is arranged at a terminal end of the exterior wall.

17. The method of claim 16, further comprising coupling the camshaft carrier to the cylinder head by inserting a fastener through the first section and the first mount surface.

18. The method of claim 16, wherein seating the first section of the camshaft carrier against the first mount surface includes positioning the first section through an open end of the exterior wall and within a recess formed by the exterior wall.

19. The method of claim 18, wherein positioning the first section within the recess formed by the exterior wall closes at least a portion of the exterior wall separating an interior and exterior of the cylinder head.

20. The method of claim 19, further comprising coupling the cylinder head to an engine block by inserting a head bolt through the engine block and a second mount surface of the cylinder head formed within the recess at the terminal end.

* * * * *